US010209036B1

(12) United States Patent
Rose, Jr. et al.

(10) Patent No.: US 10,209,036 B1
(45) Date of Patent: Feb. 19, 2019

(54) BALLISTIC SHADE SYSTEM

(71) Applicant: Burose, LLC, Rocky Mount, NC (US)

(72) Inventors: Dillon W. Rose, Jr., Rocky Mount, NC (US); James W. Burns, Lookout Mountain, TN (US)

(73) Assignee: Burose, LLC, Rocky Mount, NC (US)

( * ) Notice: Subject to any disclaimer, the term of this patent is extended or adjusted under 35 U.S.C. 154(b) by 0 days.

(21) Appl. No.: 16/055,742

(22) Filed: Aug. 6, 2018

(51) Int. Cl.

| | |
|---|---|
| ***F41H 5/24*** | (2006.01) |
| ***E06B 9/13*** | (2006.01) |
| ***E06B 9/70*** | (2006.01) |
| ***E06B 9/72*** | (2006.01) |
| *E06B 5/10* | (2006.01) |

(52) U.S. Cl.
CPC ..... *F41H 5/24* (2013.01); *E06B 9/13* (2013.01); *E06B 9/70* (2013.01); *E06B 9/72* (2013.01); *E06B 5/10* (2013.01)

(58) Field of Classification Search
CPC ... F41H 5/24; E04H 9/04; E05G 5/003; E06B 5/10; E06B 9/70; E06B 9/68
See application file for complete search history.

(56) References Cited

U.S. PATENT DOCUMENTS

| | | | | |
|---|---|---|---|---|
| 983,663 | A | 2/1911 | White | |
| 1,487,926 | A | 3/1924 | Evans | |
| 4,235,491 | A | 11/1980 | Korber et al. | |
| 6,886,299 | B2 | 5/2005 | Gower | |
| 9,702,665 | B1 | 7/2017 | Rose, Jr. et al. | |
| 2016/0209181 | A1* | 7/2016 | Adrain | E06B 9/264 |
| 2016/0230444 | A1* | 8/2016 | Hahn | F41H 5/045 |

FOREIGN PATENT DOCUMENTS

| | | | |
|---|---|---|---|
| AU | 2009201524 | A1 | 12/2009 |
| DE | 3407580 | A1 | 9/1985 |
| FR | 2993307 | A1 | 7/2015 |

OTHER PUBLICATIONS

"Safe Zone Ballistics LLC.—Leaders in Blast Protection", http://ww.safezoneballistics.com/blast-resistant.html, Jun. 20 2016.
"Bolt Rope—Wikipedia", https://en.wikipedia.org/wiki/Bolt_rope, Mar. 21, 2018.

* cited by examiner

*Primary Examiner* — J. Woodrow Eldred
(74) *Attorney, Agent, or Firm* — James G. Passé; Passé Intellectual Property, LLC

(57) ABSTRACT

The present invention relates to a ballistic shade system which provides a means for rolling up and down ballistic material and holding it in place during a ballistic event.

6 Claims, 4 Drawing Sheets

BALLISTIC SHADE SYSTEM

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a ballistic system. In particular, it relates to a roller system for utilizing ballistic material to cover a building opening, such as a door or window.

Description of Related Art

The more frequent occurrence of intruders in schools, businesses, government facilities, and the like has highlighted safety needs for people working or using such facilities. Intruders these days are armed with various versions of high powered rifles that do tremendous damage as well as make most locking devices ineffective. Facilities are constantly attempting to prevent an intruder from entering classrooms, offices, and the like. When dealing with an intruder, many places go into a lockdown situation wherein people remain in the places/rooms where they are. The responders can take an average of 18 minutes before they can reach and deal with the situation, if no security is readily present. Keeping the occupants of a room or building safe from intruder entry is the critical priority and represents the most effort while waiting for responders. Effective entry prevention, as well as protection from penetration of bullets (especially high powered bullets), is needed to allow time for the responders to arrive and protect the occupants in the room or building.

In schools and most buildings, there are many kinds of doors and windows of various shapes. Some swing outward, while others swing inwards. In addition, some doors are double doors that open in the middle of the two doors, either in or out. Windows as well take on various shapes, though most of these are usually some rectangular form.

Many rooms in these situations have a window in the door or next to the door, making it relatively easy to break the window and reach in and unlock the door and open it with the door knob. These doors and windows are easy to see through and allow an intruder to do great damage, even if the door remains locked and closed.

The devices attempting to deal with this type of situation have used various approaches. Devices to prevent entry, metal roll-up doors, door locks, and the like have all been tried with various levels of effectiveness. Many ballistic materials are available. Many of them, like Kevlar®, are solid sheets and are not flexible, making them unsuitable for door and window protection. A new generation of more flexible ballistic materials are available, such as those made by Safe Zone Ballistics, LLC, and, while they are very flexible, they, however, cannot be just placed on standard shade or other roller door/window devices and remain effective ballistic materials. Accordingly, there needs to be a new system for utilizing this ballistic material effectively to prevent ballistic weapon entry of doors and windows. A newer design involves a roller shade system rolling up and down during a ballistic event. Even then though, any channels the shade moves through can be a weakness. A new system of holding the edges of the fabric is needed.

BRIEF SUMMARY OF THE INVENTION

The present invention is the novel ballistic shade system which overcomes the problems inherent with other systems for ballistic protection. It has been discovered that by the combining flexible ballistic material with a drive system (that also fits into side tracks), the ballistic material is delivered evenly and with a ballistic hit, is difficult to dislodge, as noted in the tests the invention has passed, listed below. It is guided in channels by a boltrope sewn into the ballistic material.

Accordingly, in an embodiment, there is a ballistic shade system designed to cover an opening in an interior wall of a building and to provide ballistic protection for the opening when the shade system is in use, comprising:

a) a ballistic fabric having a first and second length edge wherein each of the first and second length edges has a first end of a boltrope centered inside the ballistic fabric and a boltrope ball end to travel in a side track;

b) a motor that rotates the roller and rolls the ballistic material shade on and off the roller;

c) a pair of side tracks mounted on the wall next to the opening, having a guide channel for the ballistic material and an adjoining guide channel for the boltrope ball designed and positioned to guide the length edges of the shade as the ballistic material is driven on and off the roller; and d) wherein the bottom horizontal edge of the ballistic material has a bottom bar.

DETAILED DESCRIPTION OF THE INVENTION

Figure 1:
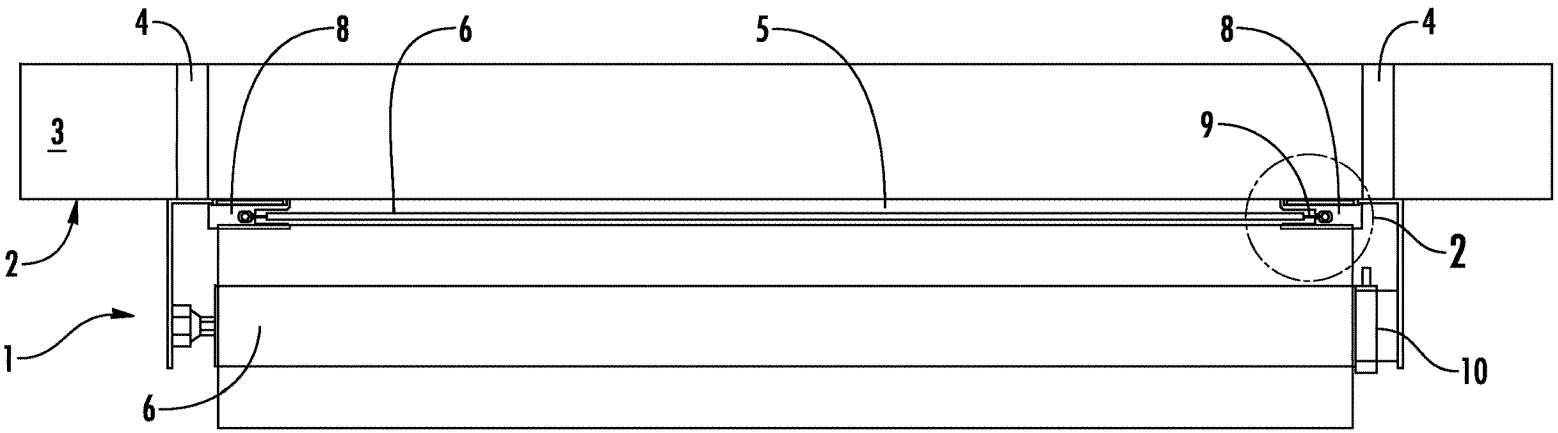
FIG. 1 is a top perspective view of the present system mounted on the inside surface of an outside wall, having a window as the opening.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

References throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, the term "ballistic shade system" refers to material designed to provide ballistic protection to an opening in a wall of a building. The ballistic material can be deployed or placed out of the way using the entire system of the invention. Unlike standard roller shades or roll up metal doors, like garage doors or the like, in order to provide ballistic protection, the system has to be able to hold the ballistic material in place when engaged, such as when hit by bullets, a blast, or the like, during an entry attempt. If not held in place, the material is blown aside, providing easy entry. Therefore, a system that holds the length edges is critical to performance. While no system is totally impervious or completely resistant to high powered weapons or explosives, if protection is provided for a period of time (e.g. half an hour, an hour, 2 hours or more), it provides sufficient time for authorities or other help to arrive and control the situation from outside the building. The present ballistic shade system is a roller system which, when it engages ballistic material over the opening in a wall of a building (i.e. rolled down to cover the opening), provides protection from entry due to such ballistic assault.

As used herein, the term "opening in an interior wall of a building" refers to standard openings which appear in both the exterior walls and interior walls of a building. Such openings include windows, doors, pass-throughs, and the like. The system is designed to be mounted on the interior surface of a wall, e.g. the interior wall of an exterior wall. For example, the inside wall inside an office or the like.

As used herein, the term "flexible ballistic material" refers to any blast and bullet resistant flexible material that can be rolled up but can still provide ballistic protection, unlike some materials (like Kevlar®) which cannot. An example is the material made by Safe Zone Ballistics LLC, but the present invention includes any such material. In one embodiment, ballistic material is material that provides protection to at least NIJ III-A level or to 7.62 level. It can also be low-hazard blast resistant. Typically, such material has a weight of at least about 0.8 lbs per sq ft though some materials are about 3.3 lbs per sq ft or more. It is a flexible ballistic material designed to be a shade, i.e. sized and designed to be rolled up on a roller. In one embodiment, the ballistic material comprises multiple plies of a woven polymeric material. In another embodiment, there is horizontal stitching in a manner to help the fabric to roll evenly.

Figure 2:
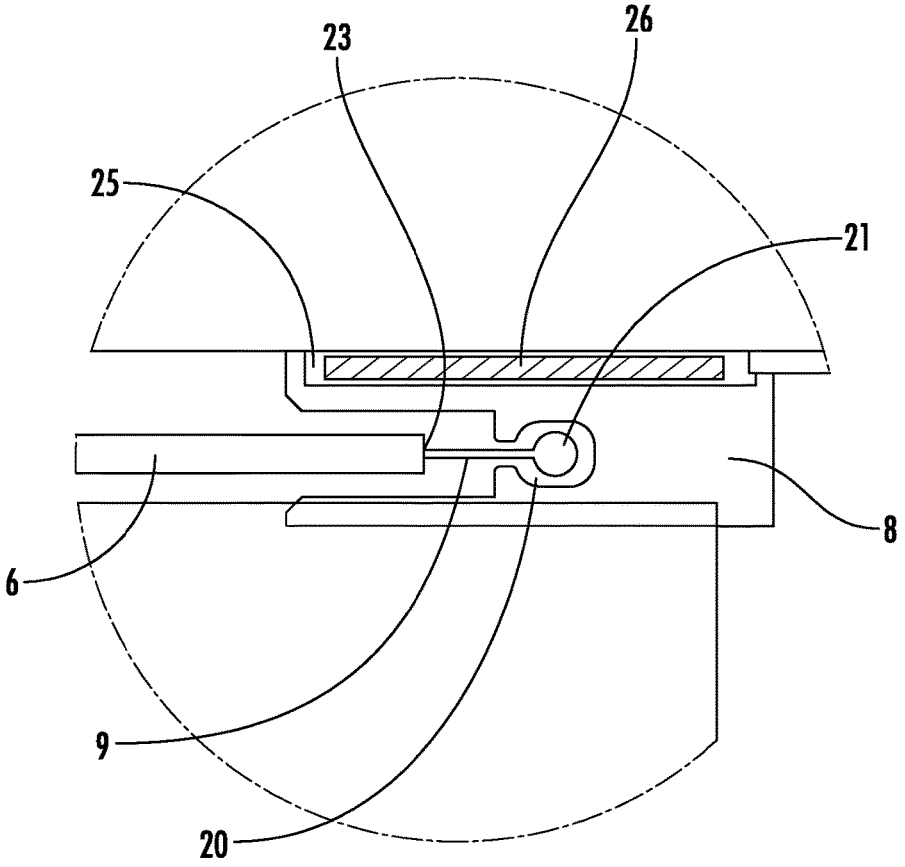
FIG. 2 is a close up view of one side of the present system.

As used herein, the term "boltrope" refers to a rope being sewn into the first and second length edge of the ballistic shade with a flange centered inside the ballistic material and a boltrope ball for moving through the side tracks. An exemplary version is shown in FIG. 2. The boltrope ball positioned in the guide tracks holds the shade in place if it is hit by a ballistic event.

As used herein, the term "ballistic protection" refers to a system wherein the system protects entry from a bullet or the like through an opening in a wall when the system is engaged covering the opening.

As used herein, the term "roller" refers to a roller that the ballistic material is rolled up on. The ballistic material is rolled on or off (providing the material up or down over the opening) by a motor positioned in the roller. In one embodiment, there are teeth in the track as well to hold the curtain in place.

As used herein, the term "motorized roller" refers to a motorized drive, such as a belt drive, for turning the roller one way or the other for the purpose of extending or retracting the curtain. The motor can be AC or DC and is a reversible motor for going in both directions. In one embodiment, the motor is inside the roller and in another embodiment, the motor is mounted externally to the roller and is connected to the roller with a drive belt.

As used herein, the term "side guide tracks" refers to channels designed to be mounted to the left and right of the opening in the wall. They are designed to channel the edges of the ballistic material up and down, while holding the edges in and keeping them from pushing out of the channel when a ballistic event hits the ballistic material. The guides each have a guide channel for the long edges of flexible ballistic material and an adjoining guide channel in communication with the guide channel for the ballistic material designed to accept the boltrope. There may also be space between the side guide tracks and the wall for insertion of a ballistic steel plate.

As used herein, the term "ballistic steel plate" refers to ballistic material positioned to protect the guide tracks. It is positioned between the side guide tracks and the wall for the purpose of protecting the channels. It does not cover the opening in the door. The side guide tracks and ballistic plates can be bolted to the structure with lag bolts.

As used herein, a bottom bar is a heavy horizontal bar at the bottom of the shade to provide the weight needed to pull the curtain down as the curtain is lowered. The purpose is also to provide rigidity to the bottom of the curtain. It also is useful because it limits the ability of an attacker to reach under the curtain. The bar can be fastened to the bottom of the ballistic fabric with steel straps and rivets or the like.

DRAWINGS

Now referring to the drawings, FIG. 1 is a top perspective view of the present system mounted on the inside surface of an outside inside wall, having a window as the opening (though this could be a door or any other wall opening, or could be an interior wall with an inside surface). In this view, the ballistic shade system 1 is mounted on the interior surface 2 of wall 3. In this view, the shade system 1 is mounted to the wall studs 4 of the window 5. In this view, side guide tracks 8 are attached to wall 3 into the wall studs 4. Boltrope 9 can be seen on either side of ballistic material 6 with one end sewn into the fabric and the boltrope ball end travels in the guide track. Motor 10 deploys and retrieves the ballistic material. In this view, we can see the system 1 in the undeployed, or stowed, view with ballistic material 6 rolled up on a roller 20 (as seen in the next figure, FIG. 2).

FIG. 2 is a close up view of one side of the ballistic material 6. The guide track 20 holds boltrope ball 21 of boltrope 9 while opposite boltrope end 23 is sewn into ballistic material's longitudinal length. The boltrope ball 21 travels in guide tracks 8 and keeps the shade in place in case of a ballistic hit by the strength of the boltrope ball staying in the guide tracks. It also guides the shade evenly into a deployed state. Channel 25 is shown as a space for insertion of ballistic steel plate 26 to protect the channels.

Figure 3:
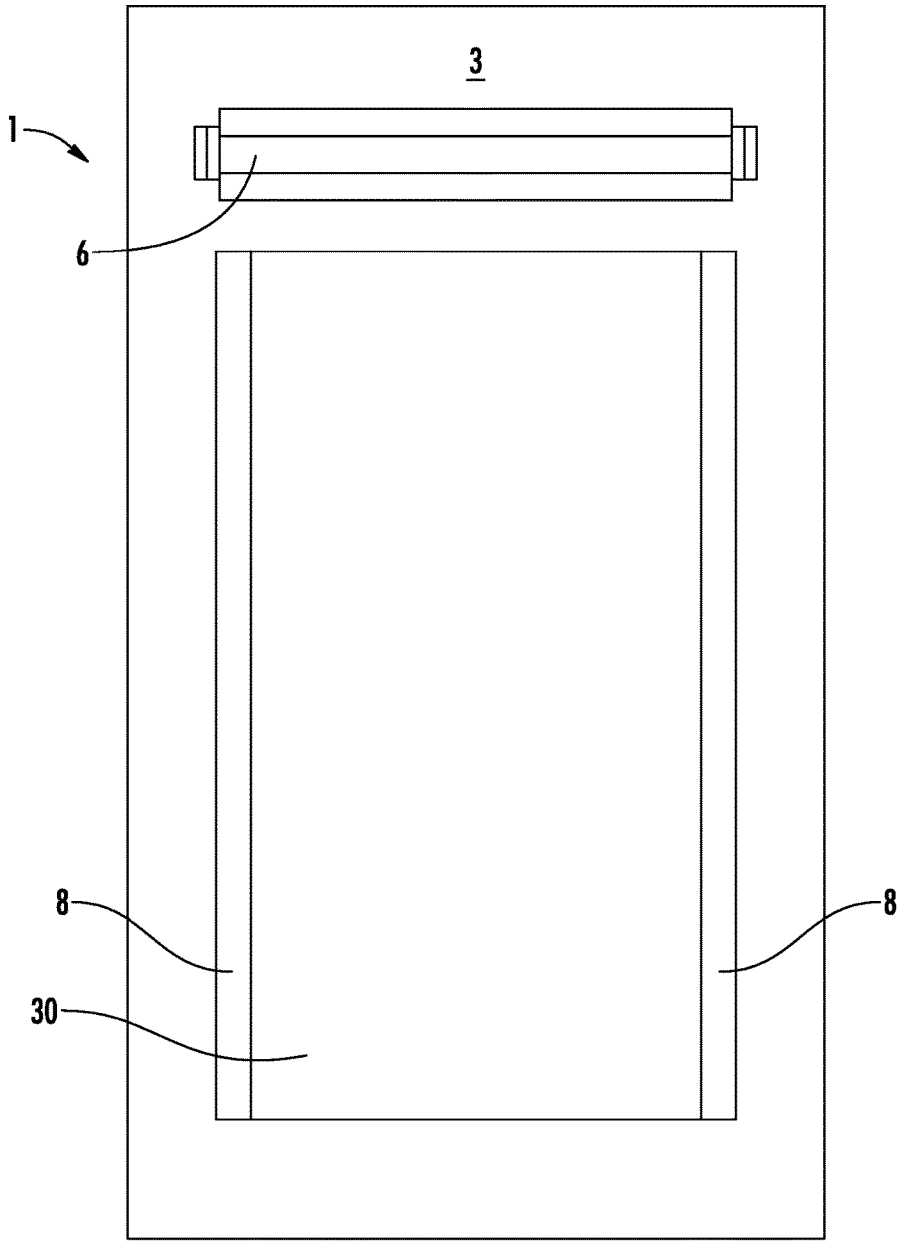
FIG. 3 is a frontal view of the present system in the non-deployed mode.

FIG. 3 is a frontal view of the ballistic system 1 in the non-deployed mode. Opening 30 is the opening to be protected. Left and right guide channels 8 are shown.

Figure 4:
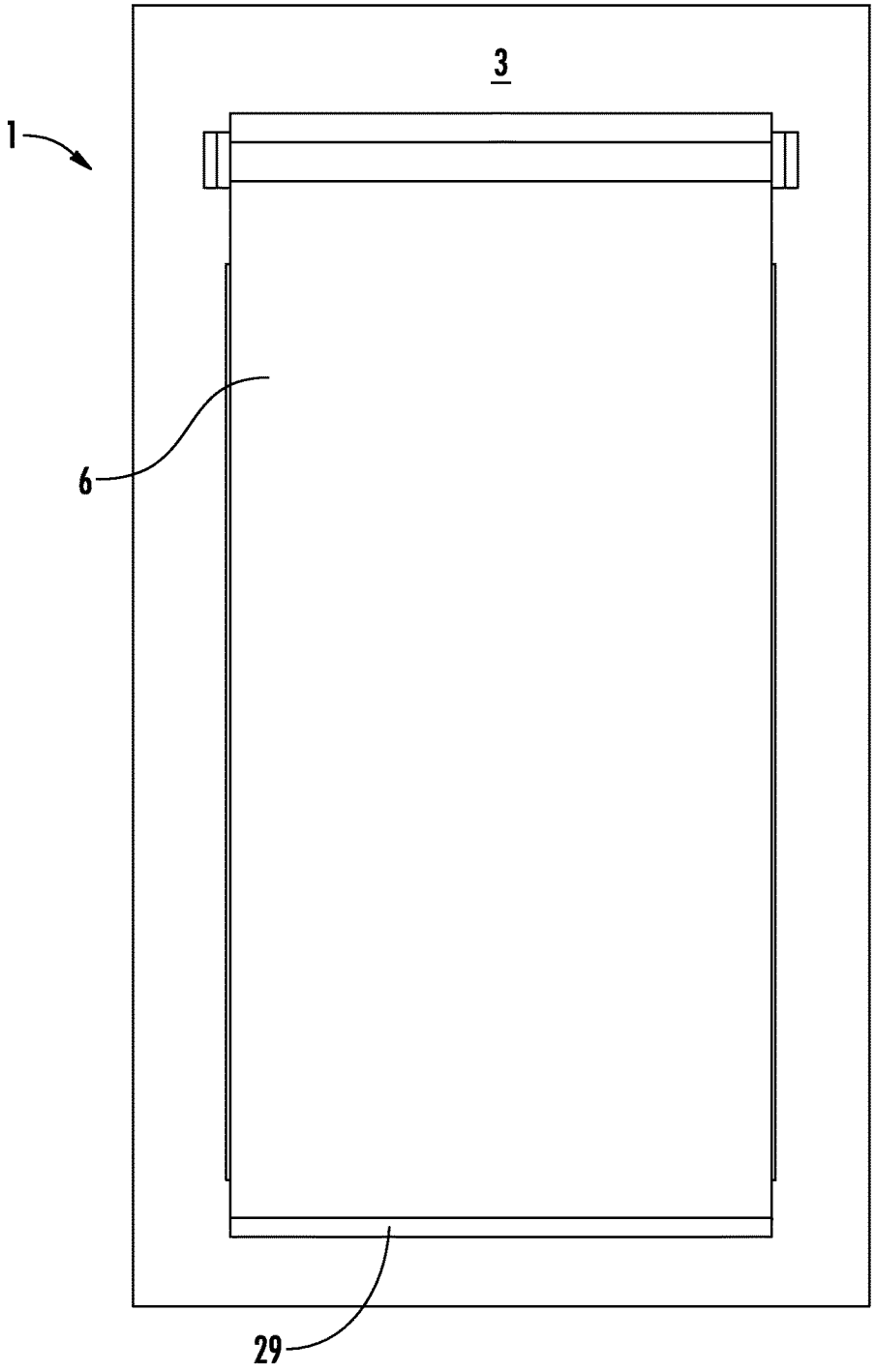
FIG. 4 is a frontal view of the present system in the deployed mode.

FIG. 4 is a frontal view of the ballistic system 1 which is fully deployed and covers opening 30 from FIG. 3. The shade is deployed into the outside track with the boltrope keeping the movement smooth and keeping the ballistic material in place. In this view, the bottom bar 29 at the bottom of the shade is shown.

During use, the motor is engaged and turns the roller. The ballistic material is guided off of the roller and guided by the boltrope into the side tracks till the opening is entirely covered. In reversing, the motor rolls the ballistic material back up on the roller.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A ballistic shade system designed to cover an opening in an interior wall of a building and to provide ballistic protection for the opening when the shade system is in use, comprising:

a) a ballistic fabric having a first and second length edge wherein each of the first and second length edges has a first end of a boltrope centered inside the ballistic fabric and a boltrope ball end to travel in a side track;

b) a motor that rotates the roller and rolls the ballistic material shade on and off the roller;

c) a pair of side tracks mounted on the wall next to the opening, having a guide channel for the ballistic material and an adjoining guide channel for the boltrope ball designed and positioned to guide the length edges of the shade as the ballistic material is driven on and off the roller; and d) wherein the bottom horizontal edge of the ballistic material has a bottom bar.

2. The system according to claim 1 wherein the opening is a door or window.

3. The system according to claim 1 wherein the motor is positioned inside the roller.

4. The system according to claim 1 which further comprises ballistic rated steel positioned between the interior wall and each of the pair of side tracks.

5. The system according to claim 1 wherein the ballistic fabric has horizontal stitching.

6. The system according to claim 1 wherein a first and second end of the bottom bar fits into the pair of side tracks.

* * * * *